United States Patent [19]

Wirtschafter

[11] 4,448,541

[45] May 15, 1984

[54] MEDICAL TIMER APPARATUS

[75] Inventor: Jonathan D. Wirtschafter, Minneapolis, Minn.

[73] Assignee: Mediminder Development Limited Partnership, Minneapolis, Minn.

[21] Appl. No.: 421,681

[22] Filed: Sep. 22, 1982

[51] Int. Cl.[3] ..... G04B 47/00

[52] U.S. Cl. ..... 368/10; 368/320

[58] Field of Search ..... 368/10, 215, 98, 12, 368/97, 101, 215, 89; 340/390.1, 390.15; 215/DIG. 3; 221/2

[56] References Cited

U.S. PATENT DOCUMENTS

| | | | |
|---|---|---|---|
| 4,034,757 | 7/1977 | Glover | 368/10 |
| 4,211,991 | 7/1980 | Lombard et al. | 335/207 |
| 4,258,354 | 3/1981 | Carmon et al. | 368/10 |
| 4,367,955 | 1/1983 | Ballew | 368/10 |

*Primary Examiner*—Bernard Roskoski

*Attorney, Agent, or Firm*—Henderson & Sturm

[57] ABSTRACT

A medical timer apparatus being suitable for use with both integral and non-integral medication containers, and having a magnetically responsive switch for resetting the time measurement function. The magnetically responsive switch responds to magnets positioned such that the magnets will be brought into operable range of the magnetically responsive switch by activities that are consistent with administration of the medicine.

3 Claims, 7 Drawing Figures

MEDICAL TIMER APPARATUS

TECHNICAL FIELD

This invention relates generally to medical timer mechanisms.

BACKGROUND ART

Many drugs and medications currently prescribed by physicians require periodic administration at specified times. If the patient errs and repeats the dosage too frequently, an overdose may result. Similarly, if the patient should fail to administer the medication at the proper time intervals, the concentration of medicine in the patient's body may become to low.

Therefore, certain time keeping responsibilities are clearly imposed when taking a medication. This time keeping responsibility falls of necessity upon either the patient or those who care for him. With regard to the latter, the problems are aggravated if more than one person cares for the patient, such as in a family or institutional setting. The multiple attendants must accurately communicate with one another or confusion may result as to when medication should again be administered. This situation may lead to under or over dosage of the medication.

Perhaps most commonly, the patient will note the current time on a watch or other standard time keeping device. On the basis of a physician's instructions regarding the minimum and maximum safe intervals between doses of medication, and on the basis of the total amount of medication to be administered over a possibly extended period of time, the patient then calculates the time when the next medication should be taken and commits the calculated time to memory. When the later time arrives, the patient readministers the medication and repeats the process.

A number of disadvantages become apparent in this prior art method. For instance, the patient or caretaker may not correctly remember the appropriate time, of the individual may be otherwise distracted at the predetermined time and fail to administer the medication. These problems become particularly acute with patients whose mental or physical condition makes them less capable of reliably discharging such actions, or, as mentioned above, where a number of persons are responsible for the patient.

Other suggested solutions to this problem are found in the prior art. A number of devices are designed to either minimize the mental calculation involved and/or to operate as reminder devices. Such a device may coprise a small pill case having a timer and alarm built into it such that when the alarm sounds, the patient will be alerted and hopefully act in accordance with the instructions provided by the physician's prescription.

Often, however, the patient should not use such a reuseable integral pill container, timer and alarm. For instance, it may be impossible (as with liquids), inconvenient or improper to transfer medicine from the primary container to such an integral pill box. More importantly, some medications are not suitable for use with reusable pill containers due to accumulated toxicity problems.

Perhaps more fundamental, these devices act only as simple alarm clocks that include the sometimes convenient feature of positioning the medication proximal to the clock. Other than sounding an alarm, however, no provisions are made to ensure or urge compliance with the medication schedule. The user can simply shut off the alarm and never take any further steps towards administering the medication, either through intentional or unintentional neglect, thereby risking an overdose condition. Further, if the user does take the medication on schedule, he may still neglect to restart the timing function, and thereby risk either an overdose condition or an underdose condition.

In an earlier filed U.S. patent application Ser. No. 949,800), I disclose a timer and alarm apparatus useful for the periodic dispensation of medication. This device included a pressure sensitive switch that could be operably connected to a medication container. Upon squeezing the pressure sensitive switch when opening the container, the switch would signal the alarm mechanism to terminate sounding the alarm. In other words, an act that would normally indicate compliance with the medication schedule also caused the alarm to cease.

Though the alarm termination feature of the above invention urges compliance with the prescription schedule, it did not include an integral pill container. And, just as there are times when an integral pill container may be inappropriate for use by the patient, there may also be times when an integral pill container provides necessary convenience and flexibility. In addition, the pressure sensitive switch I disclosed therein poses certain difficulties in that it may be difficult to repeatedly assure proper operation when used with a great variety of containers.

In view of the above, the prior art lacks a medical timer device suitable for use in the regular dispensation of medications that may be used either with an integral pill container or a non-integral pill container and that further includes an alarm termination and/or time measurement restart switch that responds to some parameter indicative of compliance, thereby urging compliance. In order to encourage economic efficiency, this switch should be inexpensive, and should be usable and reliable with both integral and non-integral containers.

DISCLOSURE OF INVENTION

These desired qualities are present in the instant invention which comprises an improved medical timer apparatus. The apparatus includes a timing and alarm unit, a magnetically responsive switch, an integral medicine retention unit and a non-integral medicine retention unit.

The timing and alarm unit may be comprised of any suitable mechanism that includes a timing unit and an alarm unit for setting and activating an alarm in response to time or to a pre-set time interval between doses.

The magnetically responsive switch may be provided by use of a reed switch. This switch may be configured in a normally open posture, and should be interfaced with the timing and alarm unit's alarm-termination (or squelch) and/or time measurement reset switch. By connecting the reed switch to the alarm-termination or squelch functions, the sounding of the alarm may be terminated by closing the reed switch. By connecting the reed switch to the time measurement reset switch, the measurement of time can be restarted by closing the reed switch. Finally, if the reed switch connects to both the alarm termination function and to the time measurement reset switch, both of these functions may be implemented by closing the reed switch. Preferably, any other user accessible switches for these functions should not be provided.

The integral medicine retention unit should comprise a non-permanently attachable container that operably connects to the timing and alarm unit to form an integral container unit. A small magnet should be positioned within the container unit such that when the container unit assumes an open configuration, the magnet will be brought operably proximal to the reed switch. The reed switch will then close and signal the timing and alarm unit as indicated above.

The non-integral medicine retention unit includes a non-integral medicine container, another magnet, a sponge unit and a fastening member. More particularly, the medicine container may have a section of flexible magnetic material adhered thereto. A section of sponge material may then be positioned over this magnet, and the timing and alarm unit may be disposed thereover. The fastening member may then be used to retain these elements in this configuration.

When the patient grips the container to open it and remove the medication, the pressure exerted by the user's hands will compress the sponge material and urge the timer and alarm unit, and hence the reed switch, towards the magnet. This again will cause the reed switch to close and to terminate the alarm function and/or to restart and measurement of time.

Such a timing and alarm unit may be used with integral or non-integral medicine containers as necessary and appropriate. Such flexibility should encourage continued usage of the device and hence encourage greater compliance with any prescribed dosage schedule. Further, the positioning of the magnetic switch in this capacity more reliably assures compliance than does a simple on and off switch, and a magnetic switch has been found more reliable than a simple pressure sensitive switch.

Also, the single, inexpensive, magnetically responsive switch provided in conjunction with the timing and alarm unit may be used with a variety of containers, having different sizes and shapes, including the integral one. This results in a concurrent savings of material and also contributes to the reliability of the device.

BRIEF DESCRIPTION OF THE DRAWINGS

These and other attributes of the invention will become more apparent upon a thorough review of the following description of the best mode for carrying out the invention, particularly when reviewed in conjunction with the drawings, wherein.

BEST MODE OF CARRYING OUT THE INVENTION

Figure 2:
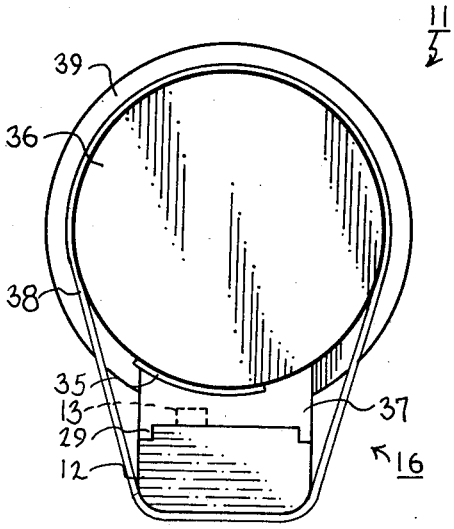
FIG. 2 is a bottom plan view of the device as shown in FIG. 1.

Referring now to the drawings, the timing and alarm unit as configured with an integral medicine container unit may be seen as denoted generally by the numeral 10 (FIG. 4) and the timing and alarm unit as configured with a non-integral medicine container unit may be seen generally as denoted by the numeral 11 (FIG. 2). More particularly, the invention includes generally a timing and alarm unit (12), a magnetically responsive switch (13), an integral medicine retention unit (14) and a non-integral medicine retention unit (16) (FIG. 2). These general components of the apparatus will now be described in more detail in seriatim fashion.

Figure 1:
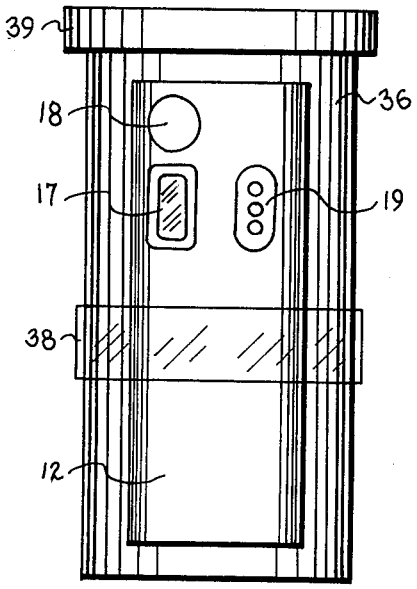
FIG. 1 is a front elevational view of the invention as attached to a non-integral medicine container.

Referring now to FIG. 1, the timing and alarm unit (12) may be provided by use of a timing and alarm device manufactured by Benders Ltd. of Hong Kong. This timing and alarm unit (12) includes appropriate electrical circuitry (not shown) for measuring time, for setting a preset time interval, and for sounding an alarm when the preset time interval has expired. The unit (12) further includes an LCD readout (17) to display the time, an alarm transducer (18) for sounding an alarm and control switches (19) for restarting the measurement of time, squelching the alarm and the like. Finally, the various electronic components of the timing and alarm unit (12) are powered by a battery (not shown) that may be located within a battery compartment (21) (FIG. 7).

Figure 4:
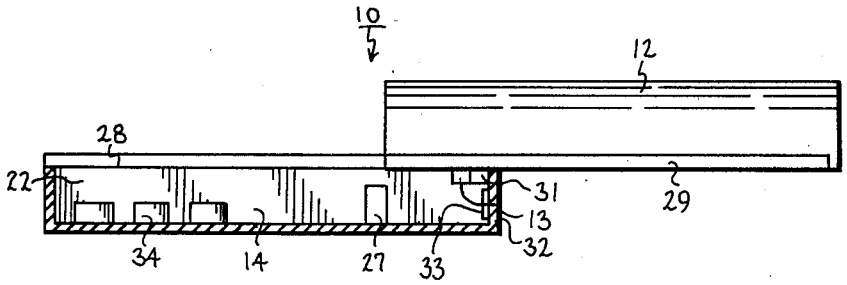
FIG. 4 is a side elevational view of the apparatus as configured with an integral medicine container, with the container portion being sectioned along the plane indicated in FIG. 6.
Figure 5:
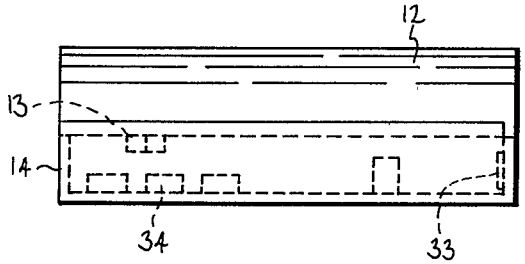
FIG. 5 is a side elevational view of the invention as configured in FIG. 4, with the integral medicine container shown in a closed position.
Figure 6:
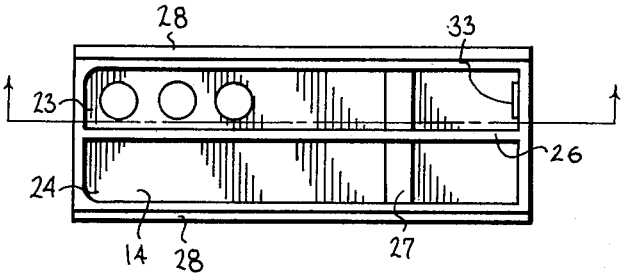
FIG. 6 is a top plan view of the integral medicine container unit.

Referring now to FIGS. 4 and 5, the Bender's unit also includes a slidably connected pill drawer (22) that may be utilized as the integral medicine retention unit (14). Referring to FIG. 6, the integral medicine retention unit (14) includes two parallel disposed pill retention troughs (23 and 24) that are separated by a longitudinally disposed partition wall (26). A laterally disposed panel (27) is provided to restrain any medication placed within the integral medicine retention unit (14) from becoming disposed within a non-accessible portion of the unit (14). A retaining flange (28) is also disposed longitudinally on either side of the integral medicine retention unit (14), which flanges (28) slidably interact with a retaining flange slot (29) (FIG. 4) provided on the timing and alarm unit (12).

Figure 7:
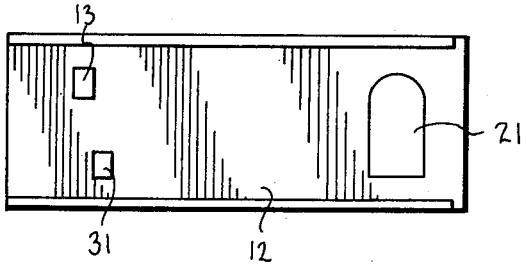
FIG. 7 is a bottom plan view of the timing and alarm unit.

Referring to FIGS. 4 and 7, the underside of the timing and alarm unit (12) includes a stop block (31) and a magnetically responsive switch (13) disposed thereon. As particularly denoted in FIG. 4, the step block (31) comes into operable connection with an end wall (32) of the integral medicine retention unit (14), thereby preventing the integral medicine retention unit (14) from being normally opened beyond the stop block (31).

A small magnet (33) may then be appropriately disposed within the integral medicine retention unit (14) such that when the first medicine retention unit (14) becomes positioned in a substantially opened configuration as shown in FIG. 4, the magnet (33) will cause the magnetically responsive switch (13) to close. The magnetically responsive switch (13) may be internally located within the timing and alarm unit (12) or may be attached to the exterior as depicted here. The magnetically responsive switch (13) may be connected to the timing and alarm unit (12) to substitute for the otherwise provided alarm squelch switch and/or the time measurement reset switch. Therefore, when the magnetically responsive switch (13) closes, the alarm function will be terminated and/or the measurement of time will be reset and restarted.

Similarly, as viewed in FIG. 5, the magnet (13) will be distally disposed from the magnetically responsive switch (13) when the integral medicine retention unit (14) has been placed in a substantially closed position with respect to the timing and alarm unit (12). In this configuration, the magnetically responsive switch (13) will be open, the alarm function will not be impaired and measurement of time will continue.

The non-integral medicine retention unit (16) will now be described with reference to FIG. 2. The non-integral medicine retention unit (16) includes a magnet (35), a non-integral medicine container (36), a sponge-like member (37) and a fastening member (38).

The magnet (35) may be conveniently provided by use of a magnetically active pressure sensitive adhesive tape, such as Plastiform brand magnet tape (MGO-1017). An appropriate sized section of this magnetic tape may be adhesively connected to the non-integral medicine container (36).

The sponge-like member (37) may be disposed between the magnet (35) and the timing and alarm unit (12). (It should be noted that for this application, the integral medicine retention unit (14) should be removed from the timing and alarm unit (12).) If desired, the sponge-like material (37) may be shaped to conform to the surface and retaining flange slots (29) of the timing and alarm unit (12).

Finally, the fastening member (38) may be any suitable mechanism to retain the above noted components in the configuration described. In this case, an elastic, adhesive tape has been represented.

Figure 3:
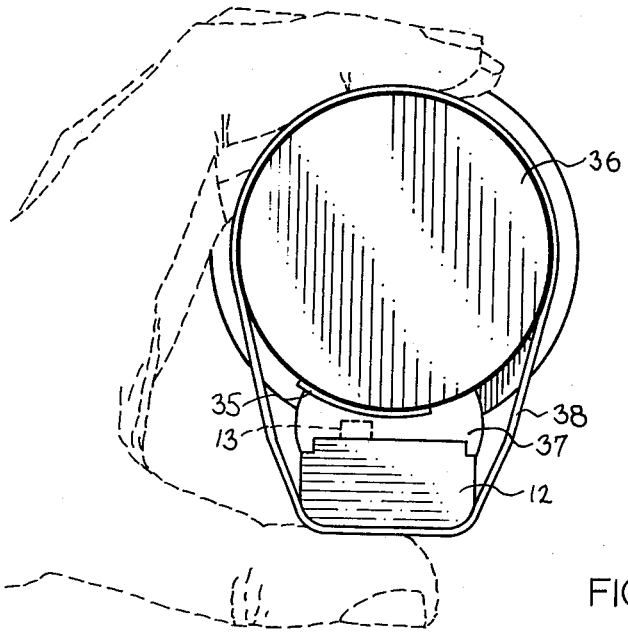
FIG. 3 is a bottom plan view of the device as shown in FIG. 1 and as grasped by a hand to show the repositioning of the magnetically responsive switch with respect to the magnetic surface.

As shown in FIG. 2, the sponge-like material (37) normally urges the timing and alarm unit (12) and hence the magnetically responsive switch (13) away from the magnet (35). With reference to FIG. 3, however, when the apparatus has been grasped in order to allow the user to remove the cap (39) from the non-integral medicine container (36), the spongelike material (37) will compress. Such compression allows the magnetically responsive switch (13) to approach the magnet (35) and hence close the switch (13) and thereby terminate the alarm function and/or restart the measurement of time.

It should be appreciated that through the provision of this invention, a single timing and alarm unit may be utilized with either an integral medicine container or a non-integral medicine container, such as the original prescription container or bottle. In addition, whether the timing and alarm unit (12) is utilized with an integral or a non-integral container, the alarm function of the timing and alarm unit (12) will only be terminated and/or the measurement of time will only be restarted in response to conditions that suggest compliance with the medication schedule.

Where, preferably, both functions are controlled by the magnetically responsive switch (13) the user will be doubly protected. First, the user must take steps that are consistent with compliance in order to squelch the alarm; namely, open the pill drawer or grasp the pill container. Having taken this step in the right direction, the user should be more likely to complete the regimen and administer the medication. Second, the user will be protected against forgetting to restart the measurement of time, since this function will be automatically attended to upon closing the magnetically responsive switch (13). Both of these features should urge greater compliance with the prescription schedule.

It should also be appreciated that the provision of only one magnetically responsive switch (13) yields reliable operation with both integral and non-integral containers, thereby encouraging economic efficiency.

Accordingly, it is believed that all of the objects mentioned above are accomplished by careful observation of the best mode for carrying out the invention disclosed herein. Obviously, many modifications and variations of the present invention are possible in light of the above teachings. It is therefore to be understood that, within the scope of the appended claims, the invention may be practised otherwise than as specifically described.

I claim:

1. In medical timer apparatus having means for measuring time, an improvement comprising:

(a) providing said apparatus with a magnetically responsive switch for restarting the measurement of time;

(b) providing said apparatus with an integral medication container that may be selectively opened and closed with respect to said apparatus to make accessible and non-accessible, respectively, medication located within said integral container and further including within said integral container a first magnet, such that opening said integral container will position said magnet to activate said magnetically, responsive switch, and wherein said integral medication container may be non-permanently attached and removed, selectively, to and from said apparatus, and further including:

(c) providing said apparatus with non-integral container attachment means for use with a non-integral medication container, comprising:

(i) a second magnet attached proximal to the non-integral medication container;

(ii) sponge means for disposition between said magnetically responsive switch, and the non-integral medication container; and (iii) fastening means for maintaining said apparatus in operable attachment with said non-integral medication container, such that upon squeezing said combined non-integral medication container, attachment means and apparatus, the magnet of said attachment means will activate said magnetically responsive switch.

2. The improvement of claim 1 wherein said second magnet comprises a substantially flexible magnetic material having adhesive disposed on at least one side thereof such that said second magnet may be affixed to the non-integral medication container.

3. The improvement of claim 1 wherein said medical timer apparatus includes alarm means for setting and activating an alarm, and said magnetically responsive switch operates also to terminate activation of said alarm.

* * * * *